US010914206B2

(12) United States Patent
Matsuura et al.

(10) Patent No.: US 10,914,206 B2
(45) Date of Patent: Feb. 9, 2021

(54) CYLINDER BLOCK STRUCTURE FOR ENGINE

(71) Applicant: Mazda Motor Corporation, Hiroshima (JP)

(72) Inventors: Hirokazu Matsuura, Higashihiroshima (JP); Keisuke Yamaguchi, Hiroshima (JP); Kenta Honda, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/491,945

(22) PCT Filed: Feb. 13, 2018

(86) PCT No.: PCT/JP2018/004866
§ 371 (c)(1),
(2) Date: Sep. 6, 2019

(87) PCT Pub. No.: WO2018/179926
PCT Pub. Date: Oct. 4, 2018

(65) Prior Publication Data

US 2020/0072099 A1 Mar. 5, 2020

(30) Foreign Application Priority Data

Mar. 29, 2017 (JP) ..... 2017-065800

(51) Int. Cl.
*F01M 1/02* (2006.01)
*F01M 11/02* (2006.01)
(Continued)

(52) U.S. Cl.
CPC ..... *F01M 1/02* (2013.01); *F01M 11/02* (2013.01); *F02F 1/20* (2013.01); *F02F 7/0082* (2013.01);
(Continued)

(58) Field of Classification Search
CPC .. F01M 1/02; F01M 11/02; F01M 2001/0269; F01M 2001/0284; F02F 1/20; F02F 7/0082
See application file for complete search history.

(56) References Cited

U.S. PATENT DOCUMENTS

2005/0205042 A1 9/2005 Odashima
2017/0074221 A1 3/2017 Shimogawa et al.

FOREIGN PATENT DOCUMENTS

JP S62165562 A 7/1987
JP H04030243 U 3/1992
(Continued)

*Primary Examiner* — Jacob M Amick
(74) *Attorney, Agent, or Firm* — Alleman Hall Creasman & Tuttle LLP

(57) ABSTRACT

This application discloses a cylinder block structure including: a cylinder block surrounding a cylinder array formed by a plurality of cylinders lined up in a first direction; a reinforcement plate including: a first fastening portion fastened to the cylinder block; and a second fastening portion fastened to the cylinder block at a position separated from the first fastening portion in a second direction that intersects with the first direction; and an oil pump that supplies oil to the cylinder block. The oil pump is fastened to the cylinder block together with the reinforcement plate. The reinforcement plate is interposed between the cylinder block and the oil pump, and has a length that is equal to or more than half of the cylinder array in the first direction.

7 Claims, 4 Drawing Sheets

(51) Int. Cl.
*F02F 7/00* (2006.01)
*F02F 1/20* (2006.01)

(52) U.S. Cl.
CPC ..... *F01M 2001/0269* (2013.01); *F01M 2001/0284* (2013.01)

(56) References Cited

FOREIGN PATENT DOCUMENTS

| | | | | | |
|---|---|---|---|---|---|
| JP | H04279709 | A | | 10/1992 | |
| JP | 2004293347 | A | | 10/2004 | |
| JP | 2011226290 | A | * | 11/2011 | ..... F01M 11/0004 |
| JP | 2011226290 | A | | 11/2011 | |
| JP | 201753322 | A | | 3/2017 | |

* cited by examiner

CYLINDER BLOCK STRUCTURE FOR ENGINE

TECHNICAL FIELD

The present invention relates to a cylinder block structure including a cylinder block in which a cylinder array is accommodated.

BACKGROUND ART

On a cylinder block in which a cylinder array is accommodated, various devices necessary for the operation of an engine are mounted (see Patent Literature 1). Patent Literature 1 discloses an oil pump mounted on the cylinder block. The oil pump supplies oil to the cylinder block.

With regards to the structure of Patent Literature 1, the oil pump is mounted on the cylinder block via a pair of small plate members. The oil pump slightly contributes to the reduction of the vibration of the engine, but cannot sufficiently suppress the vibration of the engine caused by a high peak combustion pressure set in order to obtain a high combustion efficiency required for the engine.

CITATION LIST

Patent Literature

Patent Literature 1: Japanese Patent Laid-Open No. 4-279709

SUMMARY OF INVENTION

An object of the present invention is to provide a cylinder block structure capable of sufficiently reducing the vibration of an engine.

A cylinder block structure for an engine according to one aspect of the present invention includes: a cylinder block surrounding a cylinder array formed by a plurality of cylinders lined up in a first direction; a reinforcement plate including: a first fastening portion fastened to the cylinder block; and a second fastening portion fastened to the cylinder block at a position separated from the first fastening portion in a second direction that intersects with the first direction; and an oil pump that supplies oil to the cylinder block. The oil pump is fastened to the cylinder block together with the reinforcement plate. The reinforcement plate is interposed between the cylinder block and the oil pump, and has a length that is equal to or more than half of the cylinder array in the first direction.

The cylinder block structure described above can sufficiently reduce the vibration of the engine.

The object, the features, and the advantage of the invention become clearer by the detailed description below and the accompanying drawings.

DESCRIPTION OF EMBODIMENT

Figure 1:
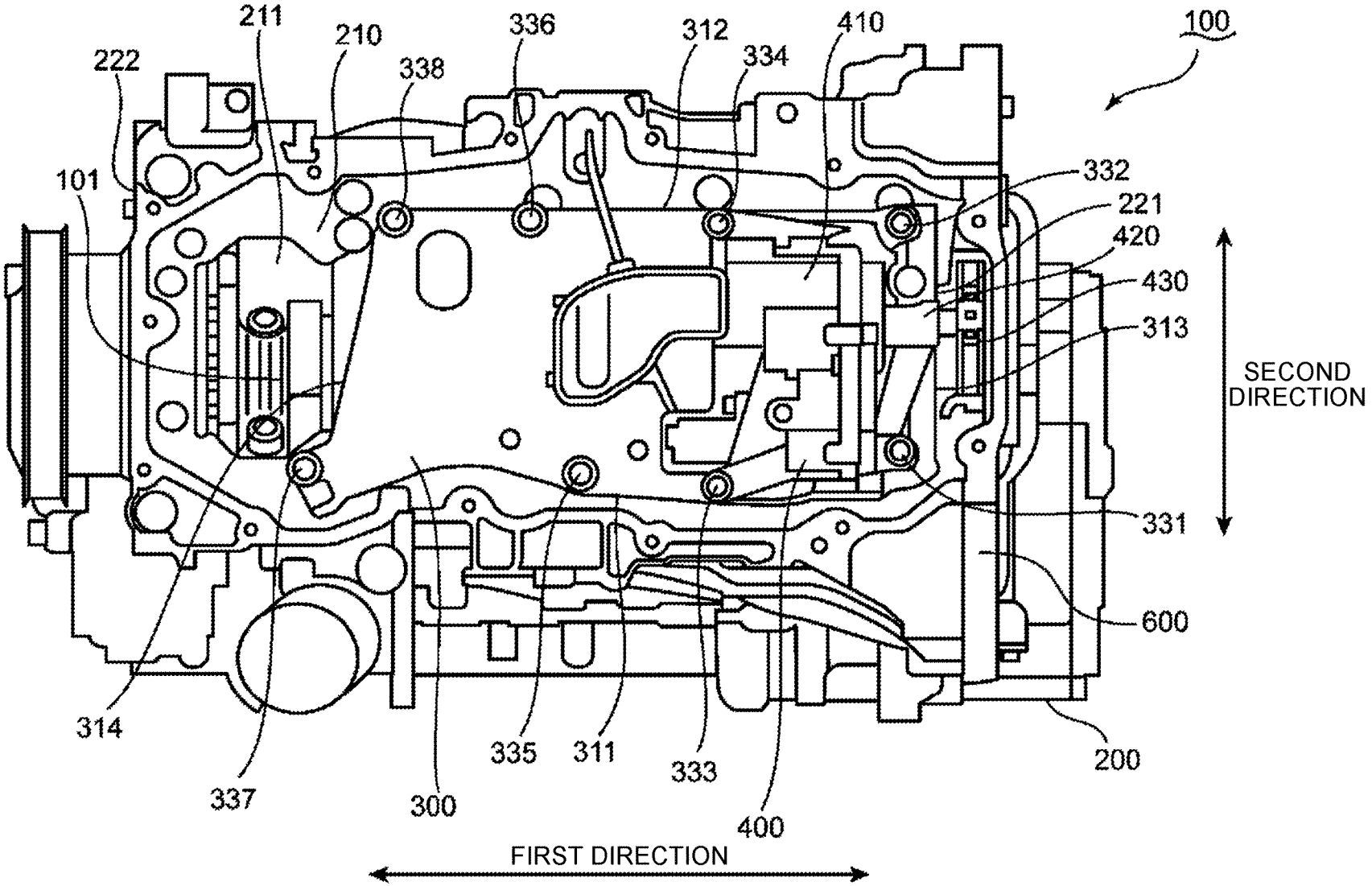
FIG. 1 is a schematic bottom view of an exemplary cylinder block structure from which an oil pan is removed.

FIG. 1 is a schematic bottom view of an exemplary cylinder block structure 100 from which an oil pan is removed. The cylinder block structure 100 is described with reference to FIG. 1.

The cylinder block structure 100 includes a cylinder block 200, a reinforcement plate 300, and an oil pump 400. The cylinder block 200 includes a bottom surface 210. FIG. 1 illustrates an opening portion 211 formed in the bottom surface 210. A part of a crankshaft 101 is illustrated in the opening portion 211. The crankshaft 101 extends in a first direction. In a plurality of cylinders (not shown), pistons are reciprocated during the operation of the engine via a plurality of connecting rods mounted on the crankshaft 101. Therefore, the plurality of cylinders are lined up in the first direction and form a cylinder array. The cylinder block 200 surrounds the crankshaft 101 and the cylinder array. Note that as illustrated in the side view of FIG. 4, a normal oil pan that covers the reinforcement plate 300 (described below) and the oil pump 400 is mounted on the bottom surface 210 of the cylinder block 200.

Figure 2:
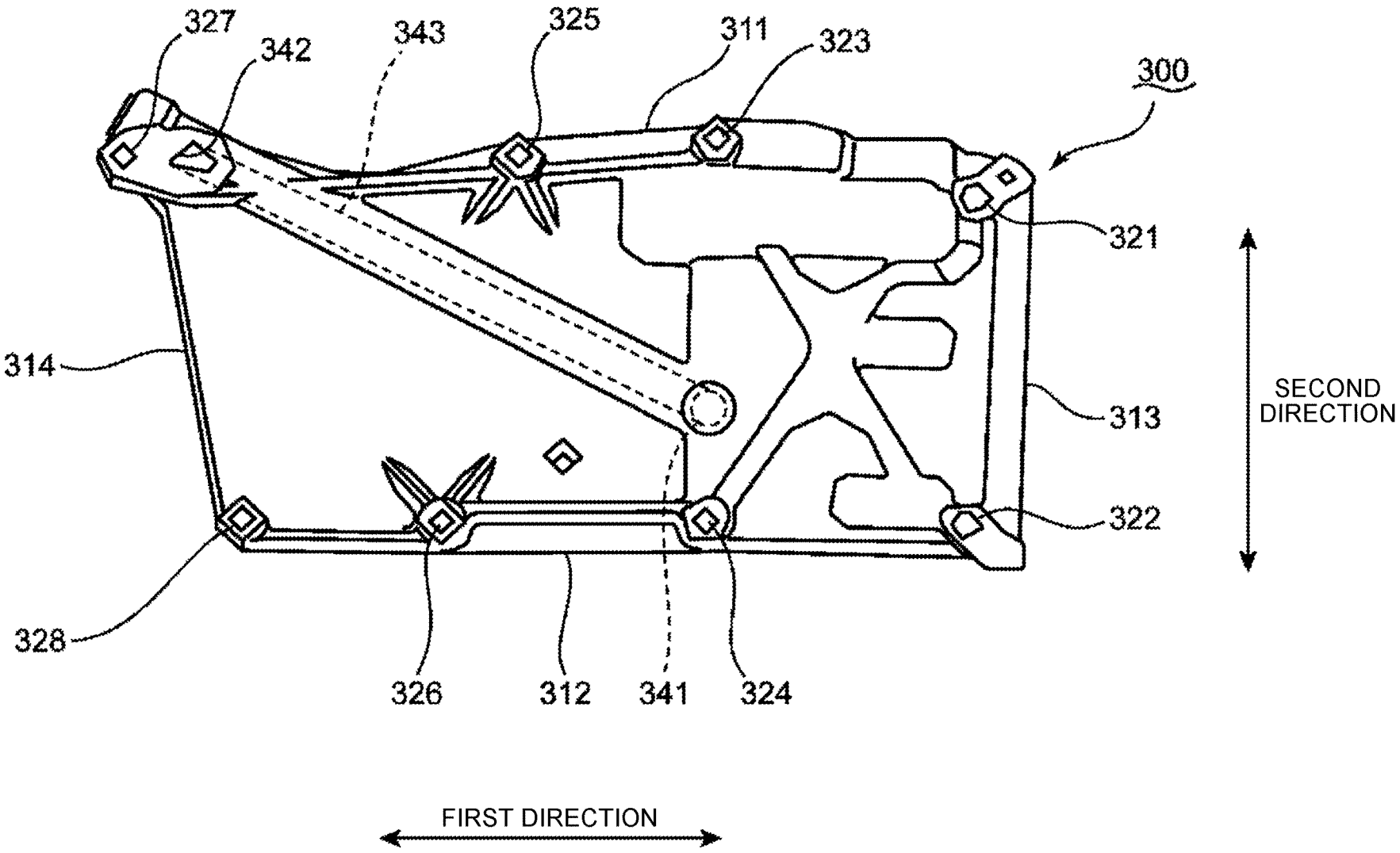
FIG. 2 is a schematic plan view of a reinforcement plate of the cylinder block structure illustrated in FIG. 1.

FIG. 2 is a schematic plan view of the reinforcement plate 300. The cylinder block structure 100 is further described with reference to FIG. 1 and FIG. 2.

The reinforcement plate 300 has a rectangular shape as a whole. The reinforcement plate 300 includes a first long edge 311, a second long edge 312, a first short edge 313, and a second short edge 314. The first long edge 311, the second long edge 312, the first short edge 313, and the second short edge 314 form the outer contour of the reinforcement plate 300. The first long edge 311 and the second long edge 312 are long in the first direction. The first short edge 313 and the second short edge 314 are long in a second direction perpendicular to the first direction. With regards to this embodiment, the second direction is perpendicular to the first direction. However, the second direction may intersect with the first direction at other angles.

As illustrated in FIG. 2, a plurality of through holes 321 to 328 are formed in the reinforcement plate 300. The through hole 321 passes through a corner portion formed by the first long edge 311 and the first short edge 313. The through hole 322 passes through a corner portion formed by the second long edge 312 and the first short edge 313. The through hole 328 passes through a corner portion formed by the second long edge 312 and the second short edge 314. The through hole 327 is formed in a place close to an end portion of the second short edge 314 on a side opposite to an end portion that forms the corner portion in which the through hole 328 is formed. The through holes 323 and 325 are formed in places close to the first long edge 311 between the through holes 321 and 327. Therefore, the through holes 321, 323, 325, and 327 are lined up along the first long edge 311 so as to be spaced apart from each other. The through holes 324 and 326 are formed in places close to the second long edge 312 between the through holes 322 and 328. Therefore, the through holes 322, 324, 326, and 328 are lined up along the second long edge 312 so as to be spaced apart from each other. The row of the through holes 322, 324, 326, and 328 is separated from the row of the through holes 321, 323, 325, and 327 in the second direction.

As illustrated in FIG. 1, the cylinder block structure 100 includes a plurality of bolts 331 to 338. The bolt 331 is inserted through the through hole 321 and is screwed in a bolt hole (not shown) formed in the bottom surface 210 of the cylinder block 200. The bolt 332 is inserted through the through hole 322, and is screwed in a bolt hole (not shown)

formed in the bottom surface 210 of the cylinder block 200. The bolt 333 is inserted through the through hole 323, and is screwed in a bolt hole (not shown) formed in the bottom surface 210 of the cylinder block 200. The bolt 334 is inserted through the through hole 324, and is screwed in a bolt hole (not shown) formed in the bottom surface 210 of the cylinder block 200. The bolt 335 is inserted through the through hole 325, and is screwed in a bolt hole (not shown) formed in the bottom surface 210 of the cylinder block 200. The bolt 336 is inserted through the through hole 326, and is screwed in a bolt hole (not shown) formed in the bottom surface 210 of the cylinder block 200. The bolt 337 is inserted through the through hole 327, and is screwed in a bolt hole (not shown) formed in the bottom surface 210 of the cylinder block 200. The bolt 338 is inserted through the through hole 328, and is screwed in a bolt hole (not shown) formed in the bottom surface 210 of the cylinder block 200. Therefore, the reinforcement plate 300 is fastened to the bottom surface 210 of the cylinder block 200 by the bolts 331 to 338.

The oil pump 400 supplies oil to the cylinder block 200. The oil is supplied to various hydraulic driving devices (not shown) through a flow path (not shown) formed in the cylinder block 200.

The oil pump 400 includes a pump housing 410, a rotating shaft 420, a sprocket 430, and a pump mechanism (not shown). The pump mechanism is accommodated in the pump housing 410. A part of the rotating shaft 420 is inserted in the pump housing 410. The pump mechanism is driven by the rotation of the rotating shaft 420 and discharges oil. The pump mechanism may have structures included in various known pump devices. For example, the pump mechanism may have the structure of a known variable displacement oil pump, or may have the structure of other oil pumps. Therefore, the principle of this embodiment is not limited to a particular structure of the pump mechanism.

The rotating shaft 420 protrudes from the pump housing 410. The sprocket 430 is mounted on the rotating shaft 420. With regards to this embodiment, a second sprocket is exemplified by the sprocket 430.

The cylinder block structure 100 further includes a chain mechanism (not shown). The crankshaft 101 is rotated by the power output from the cylinder array. The rotation of the crankshaft 101 is transmitted to the sprocket 430. As a result, the rotating shaft 420 is rotated, and drives the pump mechanism in the pump housing 410.

The pump housing 410 is in abutment with the lower surface of the reinforcement plate 300. Therefore, the reinforcement plate 300 is interposed between the pump housing 410 and the bottom surface 210 of the cylinder block 200. The bolts 331 to 334 described above pass through the pump housing 410. Therefore, the pump housing 410 is fastened to the bottom surface 210 of the cylinder block 200 together with the reinforcement plate 300. With regards to this embodiment, a first fastening portion is exemplified by one of the through holes 321 and 323. A second fastening portion is exemplified by one of the through holes 322 and 324. A first fastener is exemplified by one of the bolts 331 and 333. A second fastener is exemplified by one of the bolts 332 and 334. However, the first fastener and the second fastener may be other parts (for example, caulking pins) that can fasten both of the pump housing 410 and the reinforcement plate 300 to the bottom surface 210 of the cylinder block 200. Therefore, the principle of this embodiment is not limited to particular parts used as the first fastener and the second fastener.

As illustrated in FIG. 1, the length of the reinforcement plate 300 in the first direction is longer than half the length of the bottom surface 210 of the cylinder block 200 in the first direction. This means that the length of the reinforcement plate 300 in the first direction is longer than half (for example, the length of a row of two cylinders for a four-cylinder engine) the length (the length in the first direction) of the cylinder array formed in the cylinder block 200. Therefore, the reinforcement plate 300 can reduce the vibration over a wide region of the bottom surface 210 of the cylinder block 200.

As illustrated in FIG. 1, the crankshaft 101 extends in the first direction between the row of the bolts 331, 333, 335, and 337 and the row of the bolts 332, 334, 336, and 338. Therefore, the row of the bolts 331, 333, 335, and 337 and the row of the bolts 332, 334, 336, and 338 can suppress the torsion of the reinforcement plate 300.

Other Features

The designer can apply various features to the abovementioned cylinder block structure 100. The features described below do not limit the principle of the cylinder block structure 100 described in relation to the abovementioned embodiment in any way.

Supply Route for Oil

As illustrated in FIG. 2, a flow inlet 341 into which the oil discharged from the oil pump 400 (see FIG. 1) flows is formed in the lower surface of the reinforcement plate 300. In addition to the flow inlet 341, a flow outlet 342 that continues to a flow path (not shown) formed in the cylinder block 200 is also formed in the reinforcement plate 300. The flow outlet 342 appears on the upper surface of the reinforcement plate 300. A flow path 343 that extends between the flow inlet 341 and the flow outlet 342 is formed between the upper surface and the lower surface of the reinforcement plate 300. The oil flowing into the flow inlet 341 from the oil pump 400 is guided to the flow outlet 342 by the flow path 343. Then, the oil flows out from the flow outlet 342 and is supplied to various hydraulic driving devices (not shown) through the flow path formed in the cylinder block 200.

As described above, the reinforcement plate 300 not only increases the rigidity of the cylinder block 200 but also forms a supply route for the oil. Therefore, a pipe member for guiding the oil discharged from the oil pump 400 to the cylinder block 200 is unnecessary. As a result, the cylinder block structure 100 can become light in weight and have a simplified structure.

Driving of Oil Pump

Figure 3:
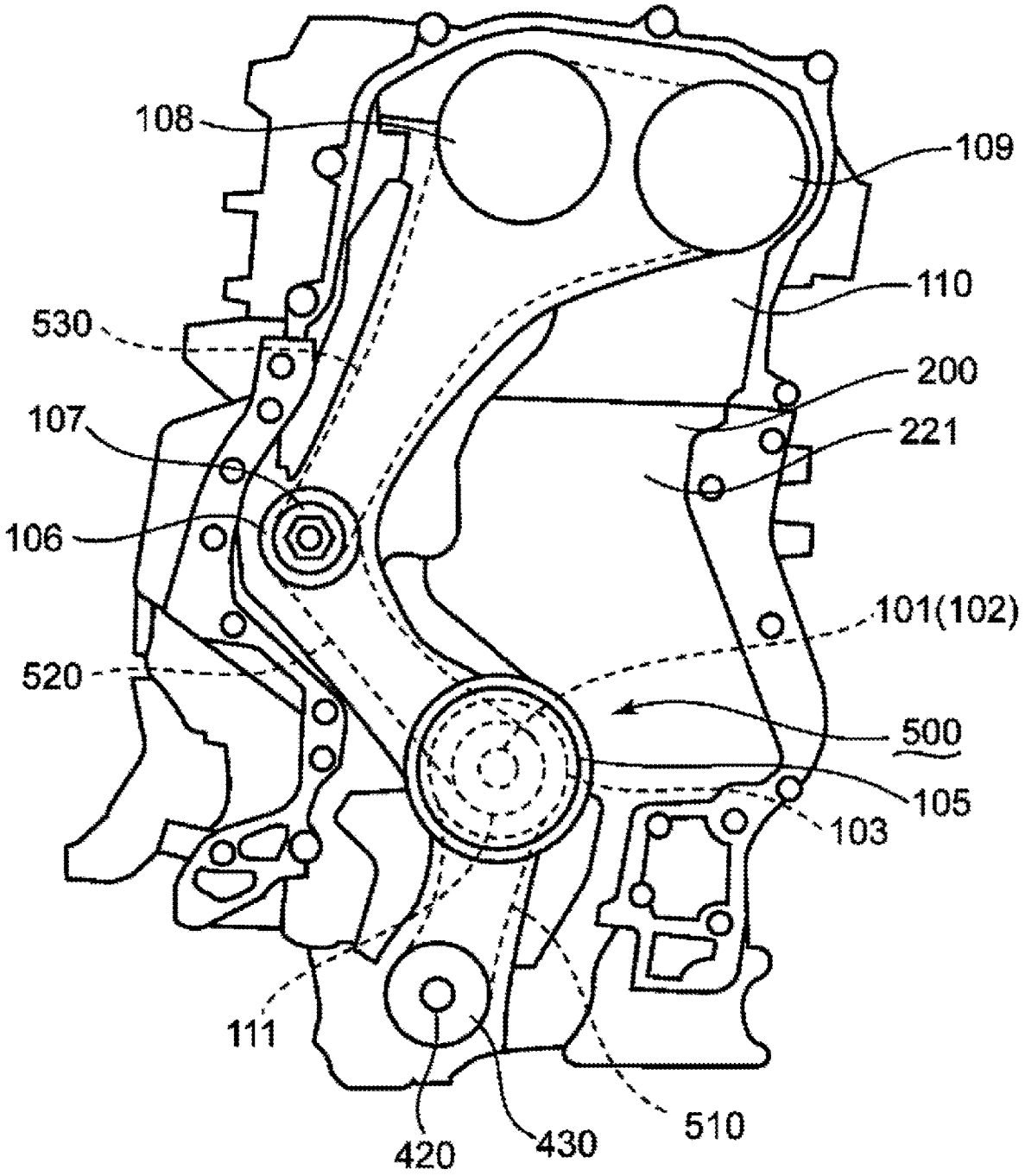
FIG. 3 is a schematic view of a chain mechanism of the cylinder block structure illustrated in FIG. 1.

FIG. 3 is a schematic view of a chain mechanism 500 described above. The chain mechanism 500 that drives the oil pump 400 is described with reference to FIG. 1 and FIG. 3.

As illustrated in FIG. 1, the cylinder block 200 includes a first surface (rear end surface) 221 and a second surface (front end surface) 222. The first surface 221 and the second surface 222 are bent upward from the bottom surface 210. Therefore, the first surface 221 and the second surface 222 are substantially perpendicular to the first direction. The second surface 222 is on the opposite side to the first surface 221. As illustrated in FIG. 3, the chain mechanism 500 is formed so as to be adjacent to the first surface 221.

The crankshaft 101 includes an output terminal 102 that protrudes from the first surface 221. The power output from the cylinder array rotates the output terminal 102. The chain mechanism 500 transmits the rotation of the output terminal 102 to the sprocket 430 of the oil pump 400.

The sprocket 103 is mounted on the output terminal 102 of the crankshaft 101. The chain mechanism 500 includes an endless chain 510 to be engaged with the sprockets 103 and 430. When the crankshaft 101 rotates, the sprocket 103 mounted on the output terminal 102 also rotates. The rotation of the sprocket 103 is transmitted to the sprocket 430 by the chain 510. As a result, the sprocket 430 rotates. As described above, the rotation of the sprocket 430 results in the rotation of the rotating shaft 420. As a result of the rotation of the rotating shaft 420, the pump mechanism (not shown) in the pump housing 410 is driven and the oil is discharged from the oil pump 400. With regards to this embodiment, a first sprocket is exemplified by the sprocket 103. A first chain is exemplified by the chain 510.

As illustrated in FIG. 1, the oil pump 400 is disposed so as to be closer to the first surface 221 than the second surface 222. In other words, the pump housing 410 of the oil pump 400 is disposed on the side of the cylinder block 200 that is close to the chain mechanism 500. Therefore, even when the rotating shaft 420 is short, the alignment between the sprockets 430 and 103 in the first direction becomes suitable. Therefore, the rotation of the crankshaft 101 is transmitted to the rotating shaft 420 and the pump mechanism in the pump housing 410 through the sprockets 103 and 430 and the chain 510.

Transmission Housing

Figure 4:
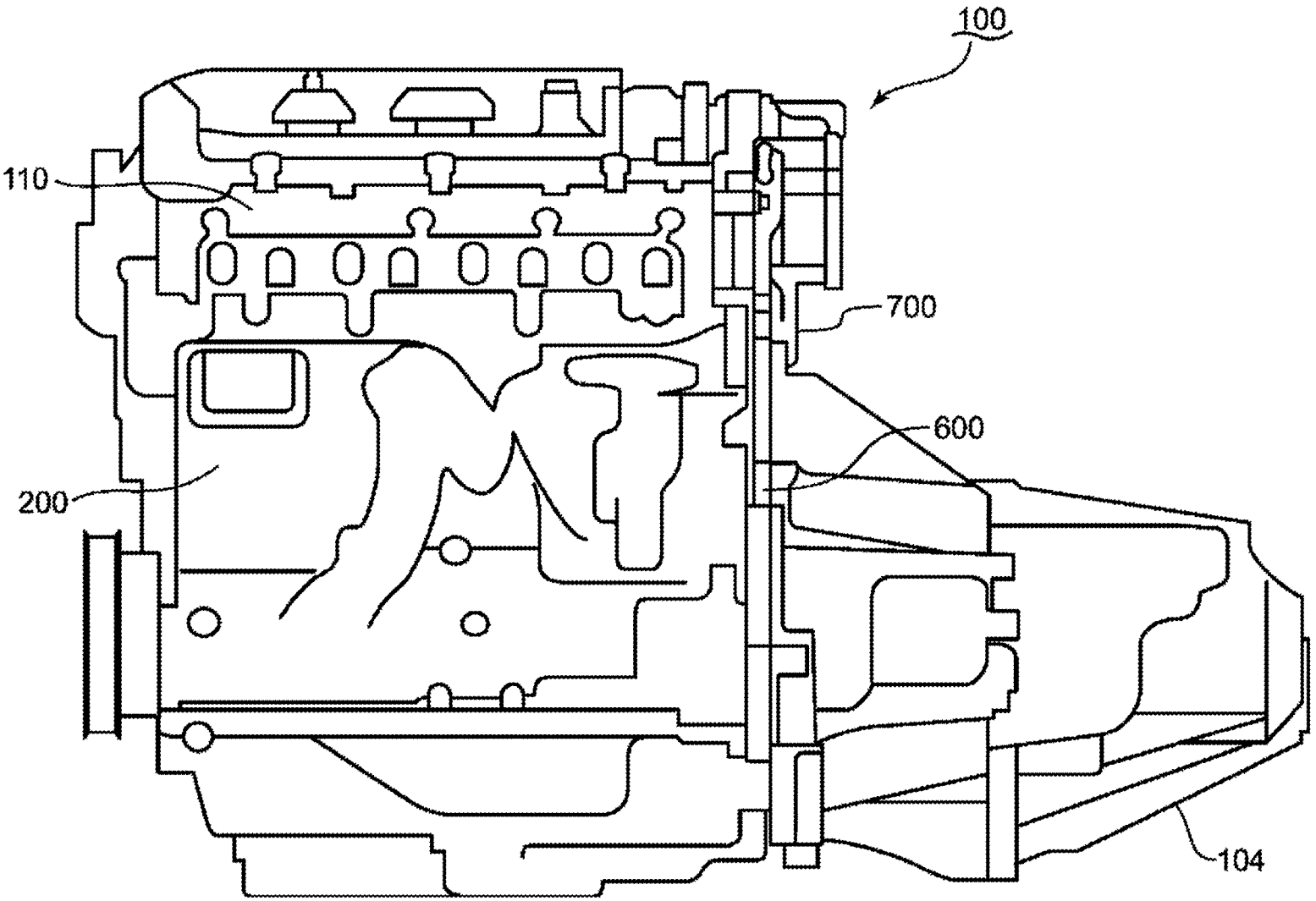
FIG. 4 is a schematic side view of the cylinder block structure illustrated in FIG. 1.

FIG. 4 is a schematic side view of the cylinder block structure 100. The cylinder block structure 100 is further described with reference to FIG. 1, FIG. 3, and FIG. 4.

FIG. 4 illustrates a transmission housing 104 in addition to the cylinder block structure 100. A transmission mechanism (not shown) is accommodated in the transmission housing 104. The transmission mechanism changes the gear ratio in accordance with the gear operation of an operator. Alternatively, the transmission mechanism changes the gear ratio under the control of a computer installed in a vehicle. As illustrated in FIG. 3, a flange 105 is mounted on the output terminal 102 of the crankshaft 101. The transmission mechanism is connected to the flange 105. In other words, the transmission mechanism is connected to the output terminal 102 via the flange 105. Therefore, the transmission mechanism can receive the power output as the rotation of the crankshaft 101. The transmission mechanism amplifies the power in accordance with the abovementioned gear ratio. The amplified power is transmitted to wheels (not shown) from the transmission mechanism. The structure of a known transmission mechanism installed in various vehicles may be applied to the transmission mechanism in the transmission housing 104. Therefore, the principle of this embodiment is not limited to a particular structure of the transmission mechanism.

The cylinder block structure 100 further includes a cover 600. The cover 600 is disposed between the first surface 221 of the cylinder block 200 and the transmission housing 104. The cover 600 is mounted on the first surface 221. The transmission housing 104 is at least partially connected to the cover 600. The cover 600 covers a part of the chain mechanism 500.

FIG. 3 illustrates a plurality of sprockets 106, 107, 108, 109, and 111. As with the sprocket 103, the sprocket 111 is mounted on the output terminal of the crankshaft 101. The sprocket 106 is used for driving a fuel injection pump (not shown) that injects fuel to the cylinder array. The sprocket 107 is disposed so as to be coaxial with the sprocket 106. The sprocket 107 rotates together with the sprocket 106. The sprockets 108 and 109 are used for rotating a camshaft that drives a plurality of valves (in other words, an intake valve and an exhaust valve: not shown) used for gas intake into the cylinder array (not shown) and gas exhaust from the cylinder array. With regards to this embodiment, a third sprocket is exemplified by the sprocket 111. A plurality of fourth sprockets are exemplified by the sprockets 108 and 109.

FIG. 3 and FIG. 4 illustrate a cylinder head 110 installed on the upper surface of the cylinder block 200. The plurality of abovementioned valves are mainly accommodated in the cylinder head 110. Therefore, the sprockets 108 and 109 are disposed so as to be adjacent to the cylinder head 110. In other words, the sprockets 108 and 109 positioned above the cylinder block 200. The sprockets 106 and 107 are disposed in a height position between the sprocket 103 and the sprockets 108 and 109.

The chain mechanism 500 includes chains 520 and 530. The chain 520 is an endless chain to be engaged with the sprockets 111 and 106. The chain 530 is an endless chain to be engaged with the sprockets 107, 108, and 109. The rotation of the sprocket 111 is transmitted to the sprocket 106 by the chain 520. Therefore, when the sprocket 111 rotates, the sprocket 106 also rotates. At this time, the sprocket 107 rotates so as to be coaxial with the sprocket 106. The rotation of the sprocket 107 is transmitted to the sprockets 108 and 109 by the chain 530. Therefore, when the sprocket 111 rotates, the sprockets 108 and 109 can also rotate. Note that the chain mechanism 500 including the sprockets 108 and 109 and the chain 530 on the cylinder head 110 side is formed from the cover 600 in a divided manner, and is covered by a cover 700 mounted on the end surface of the cylinder head 110. In other words, the chain mechanism 500 is entirely covered by the covers 600 and 700. With regards to this embodiment, at least one second chain is exemplified by the chains 520 and 530. Alternatively, at least one second chain may be a single endless chain disposed so as to be engaged with the sprockets 111, 108, and 109. The abovementioned sprockets 103 and 111 are mounted on the output terminal 102 of the crankshaft 101. However, the sprockets 103 and 111 are integrally formed on the output terminal 102.

As described above, the oil pump 400 is mounted on the bottom surface 210 of the cylinder block 200, and hence the rotating axis of the sprocket 430 mounted on the rotating shaft 420 of the oil pump 400 is positioned below the cylinder block 200. As described above, the sprockets 108 and 109 are positioned above the cylinder block 200. The cover 600 covers a part of the chain mechanism 500, and hence a space that is wide in the vertical direction is formed between the first surface 221 of the cylinder block 200 and the transmission housing 104. This means that a large vibration is easily generated between the cylinder block 200 and the transmission housing 104. However, as described with reference to FIG. 1, the oil pump 400 is disposed so as to be close to the first surface 221. Therefore, the cylinder block structure 100 can have a high rigidity especially near the first surface 221. As a result, even when the cylinder block 200, the cover 600, and the transmission housing 104 are connected to each other, the reinforcement plate 300 and the oil pump 400 can reduce the risk of occurrence of the large vibration between the cylinder block 200 and the transmission housing 104.

Unlike the region around the first surface 221, the large vibration is not easily generated around the second surface 222. Therefore, the reinforcement plate 300 does not necessarily need to entirely cover the bottom surface 210 of the cylinder block 200. As illustrated in FIG. 1, the distance from the second surface 222 to the reinforcement plate 300 is longer than the distance from the first surface 221 to the reinforcement plate 300. This contributes to the weight saving of the cylinder block structure 100.

The exemplary cylinder block structure described in relation to various embodiments described above mainly includes the following features.

A cylinder block structure for an engine according to one aspect of the abovementioned embodiment includes: a cylinder block surrounding a cylinder array formed by a plurality of cylinders lined up in a first direction; a reinforcement plate including: a first fastening portion fastened to the cylinder block; and a second fastening portion fastened to the cylinder block at a position separated from the first fastening portion in a second direction that intersects with the first direction; and an oil pump that supplies oil to the cylinder block. The oil pump is fastened to the cylinder block together with the reinforcement plate. The reinforcement plate is interposed between the cylinder block and the oil pump, and has a length that is equal to or more than half of the cylinder array in the first direction.

According to the abovementioned configuration, the cylinder block surrounds the cylinder array formed by the plurality of cylinders lined up in the first direction, and hence the vibration generated from the cylinder array is transmitted to the cylinder block. The oil pump that supplies the oil to the cylinder block is fastened to the cylinder block together with the reinforcement plate interposed between the cylinder block and the oil pump, and hence the oil pump and the reinforcement plate can contribute to the reduction of the vibration of the cylinder block. The reinforcement plate is interposed between the cylinder block and the oil pump, and has a length that is equal to or more than half of the cylinder array in the first direction, and hence can contribute to the reduction of the vibration over a wide region of the cylinder block. In addition, the reinforcement plate includes the first fastening portion fastened to the cylinder block and the second fastening portion fastened to the cylinder block at the position separated from the first fastening portion in the second direction that intersects with the first direction, and hence the torsional deformation is not easily formed in the reinforcement plate. Therefore, the reinforcement plate can function as a vibration reduction member in a stable manner.

With regards to the abovementioned configuration, a flow inlet into which the oil flows, a flow outlet from which the oil flows out, and a flow path that extends between the flow inlet and the flow outlet and guides the oil to the flow outlet from the flow inlet may be formed in the reinforcement plate.

According to the abovementioned configuration, the flow inlet into which the oil flows, the flow outlet from which the oil flows out, and the flow path that extends between the flow inlet and the flow outlet and guides the oil to the flow outlet from the flow inlet are formed in the reinforcement plate, and hence the reinforcement plate can be used to supply the oil to the cylinder block. Additional parts for guiding the oil to the cylinder block are unnecessary, and hence the cylinder block structure is light in weight.

With regards to the abovementioned configuration, the cylinder block may include a bottom surface on which the reinforcement plate is mounted. The cylinder array may be positioned between the first fastening portion and the second fastening portion when seen from below.

According to the abovementioned configuration, the cylinder array is positioned between the first fastening portion and the second fastening portion when seen from below, and hence the torsional deformation is not easily generated in the reinforcement plate. Therefore, the reinforcement plate can function as a vibration reduction member in a stable manner.

With regards to the abovementioned configuration, the cylinder block structure may further include: a first fastener penetrating the first fastening portion; and a second fastener penetrating the second fastening portion. The oil pump may include a pump housing penetrated by the first fastener and the second fastener. The first fastener and the second fastener may be connected to the cylinder block, and may fasten the reinforcement plate and the pump housing to the cylinder block.

According to the abovementioned configuration, the first fastener that passes through the first fastening portion and the second fastener that passes through the second fastening portion pass through the pump housing of the oil pump, and hence the oil pump is fastened to the cylinder block together with the reinforcement plate. As a result, the oil pump and the reinforcement plate can significantly contribute to the reduction of the vibration of the cylinder block.

With regards to the abovementioned configuration, the cylinder block structure may further include a chain mechanism including a first chain to be engaged with a first sprocket provided on a side of an output terminal of a crankshaft rotated by power output from the cylinder array. The oil pump may include: a second sprocket to be engaged with the first chain; a pump mechanism that is disposed in the pump housing and discharges the oil; and a rotating shaft which protrudes from the pump housing and on which the second sprocket is provided. The rotating shaft may be rotated by the power transmitted to the second sprocket through the first chain and may drive the pump mechanism. The pump housing may be disposed on a side of the cylinder block that is close to the chain mechanism.

According to the abovementioned configuration, the chain mechanism includes the first chain to be engaged with the first sprocket provided on the side of the output terminal of the crankshaft rotated by power output from the cylinder array, and hence the chain mechanism is driven by the crankshaft. The oil pump includes the second sprocket to be engaged with the first chain, and hence the chain mechanism can rotate the rotating shaft on which the second sprocket is provided and drive the pump mechanism in the pump housing with use of the power output from the cylinder array. As a result, the oil pump can supply the oil to the cylinder block.

The chain mechanism is disposed on the side of the output terminal of the crankshaft on which the first sprocket is provided, and hence the side opposite to the side of the output terminal can be used for the mounting of various accessories.

The pump housing is disposed on the side of the cylinder block that is close to the chain mechanism, and hence the rotating shaft that protrudes from the pump housing does not become excessively long. Therefore, the power transmitted to the second sprocket through the first chain is transmitted to the pump mechanism in the pump housing through the rotating shaft in a stable manner.

With regards to the abovementioned configuration, the cylinder block structure may further include a cover that covers the chain mechanism and is disposed between the cylinder block and a transmission housing accommodating a transmission mechanism that is connected to the output terminal of the crankshaft and amplifies the power. The chain mechanism may include at least one second chain that transmits the power from a third sprocket provided on the output terminal to a plurality of fourth sprockets that rotate together with a plurality of cams that drive a plurality of valves used for gas intake into the cylinder array and gas exhaust from the cylinder array.

According to the abovementioned configuration, the cover that covers the chain mechanism is disposed between the cylinder block and the transmission housing accommodating the transmission mechanism that is connected to the output terminal of the crankshaft and amplifies the power, and hence the side on which the transmission housing is not disposed (in other words, the side opposite to the side of the output terminal of the crankshaft) can be used for the mounting of various accessories.

The chain mechanism includes at least one second chain that transmits the power from the third sprocket provided on the output terminal to at least one of the plurality of fourth sprockets that rotate together with the plurality of cams that drive the plurality of valves used for gas intake into the cylinder array and gas exhaust from the cylinder array, and hence the chain mechanism overlaps on a wide region on the end surface of the cylinder block. The cover covers the chain mechanism, and hence a wide space is formed between the cover and the end surface of the cylinder block. In addition, the cover is positioned between the cylinder block and the transmission housing, and hence the vibration is particularly large around the cover. However, the oil pump is disposed near the chain mechanism, and hence the vibration around the cover is effectively reduced by the oil pump.

INDUSTRIAL APPLICABILITY

The principle of the abovementioned embodiment can be suitably applied to various vehicles.

The invention claimed is:

1. A cylinder block structure for an engine, the cylinder block structure comprising:

a cylinder block surrounding a cylinder array formed by a plurality of cylinders lined up in a first direction;

a reinforcement plate including:

a plurality of first fastening portions fastened to a bottom surface of the cylinder block; and a plurality of second fastening portions fastened to the bottom surface of the cylinder block at a position separated from the plurality of first fastening portions in a second direction that intersects with the first direction; and an oil pump that supplies oil to the cylinder block, wherein the oil pump includes a pump housing abutting a lower surface of the reinforcement plate;

the plurality of first fastening portions and the plurality of second fastening portions pass through the pump housing;

the reinforcement plate is provided with a flow inlet into which oil from the oil pump flows and a flow outlet fluidically coupled to a flow path of the cylinder block, the reinforcement plate further provided with a flow path that extends inclined with respect to the first direction, between the flow inlet and the flow outlet so that the oil flowing from the oil pump is guided from the flow inlet to the flow outlet;

the oil pump is fastened to the cylinder block together with the reinforcement plate; and the reinforcement plate is interposed between the cylinder block and the oil pump, so that the reinforcement plate has a length that is equal to or more than half of the cylinder array in the first direction.

2. The cylinder block structure for the engine according to claim 1, wherein the cylinder array is positioned between the plurality of first fastening portions and the plurality of second fastening portions when seen from below.

3. The cylinder block structure for the engine according to claim 1, further comprising:

a first fastener penetrating one of the plurality of first fastening portions; and a second fastener penetrating one of the plurality of second fastening portions, wherein the pump housing is penetrated by the first fastener and the second fastener; and the first fastener and the second fastener are connected to the cylinder block, and fasten the reinforcement plate and the pump housing to the cylinder block.

4. The cylinder block structure for the engine according to claim 3, further comprising a chain mechanism including a first chain to be engaged with a first sprocket provided on a side of an output terminal of a crankshaft rotated by power output from the cylinder array, wherein the oil pump includes:

a second sprocket to be engaged with the first chain;

a pump mechanism that is disposed in the pump housing and discharges the oil; and a rotating shaft which protrudes from the pump housing and on which the second sprocket is provided;

the rotating shaft is rotated by the power transmitted to the second sprocket through the first chain and drives the pump mechanism; and the pump housing is disposed on a side of the cylinder block that is close to the chain mechanism.

5. The cylinder block structure for the engine according to claim 4, further comprising a cover that covers the chain mechanism and is disposed between the cylinder block and a transmission housing accommodating a transmission mechanism that is connected to the output terminal of the crankshaft and amplifies the power, wherein the chain mechanism includes at least one second chain that transmits the power from a third sprocket provided on the output terminal to a plurality of fourth sprockets that rotate together with a plurality of cams that drive a plurality of valves used for gas intake into the cylinder array and gas exhaust from the cylinder array.

6. The cylinder block structure for the engine according to claim 1, wherein the cylinder block includes a first surface on a rear end side and a second surface on a front end side, a first distance between the second surface and the reinforcement plate being greater than a second distance between the first surface and the reinforcement plate.

7. The cylinder block structure for the engine according to claim 1, wherein the cylinder block includes a first surface on a rear end side and a second surface on a front end side;

a chain mechanism configured to drive the oil pump is formed adjacent the first surface;

a cover is disposed between the first surface of the cylinder block and a transmission housing;

the cover is mounted on the first surface;

the cover covers at least a part of the chain mechanism; and the oil pump is disposed close to the first surface.

* * * * *